US007258515B2

(12) United States Patent
Krondorfer

(10) Patent No.: US 7,258,515 B2
(45) Date of Patent: Aug. 21, 2007

(54) TOOL HOLDING FIXTURE AND INSERT TOOL

(75) Inventor: Harald Krondorfer, Mundelein, IL (US)

(73) Assignees: Robert Bosch GmbH, Stuttgart (DE); Tyrolit Schleifmittelwerke Swarovski K.G., Schwaz (AT)

( * ) Notice: Subject to any disclaimer, the term of this patent is extended or adjusted under 35 U.S.C. 154(b) by 540 days.

(21) Appl. No.: 10/496,145

(22) PCT Filed: Apr. 11, 2003

(86) PCT No.: PCT/DE03/01229

§ 371 (c)(1),
(2), (4) Date: May 20, 2004

(87) PCT Pub. No.: WO03/103900

PCT Pub. Date: Dec. 18, 2003

(65) Prior Publication Data

US 2004/0258497 A1 Dec. 23, 2004

(30) Foreign Application Priority Data

Jun. 10, 2002 (DE) ..... 102 25 583

(51) Int. Cl.
*B24B 45/00* (2006.01)

(52) U.S. Cl. ..... 409/231; 279/106; 279/141; 83/666; 451/360; 451/508; 403/348

(58) Field of Classification Search ..... 451/359, 451/360, 508, 509, 342; 409/231–232; 279/93–94, 279/77, 89, 141, 106–109, 35, 38; 403/348–349; 83/665–666

See application file for complete search history.

(56) References Cited

U.S. PATENT DOCUMENTS

| | | | | | |
|---|---|---|---|---|---|
| 1,470,158 | A | * | 10/1923 | Garrison | 279/136 |
| 1,561,843 | A | * | 11/1925 | Garrison | 279/136 |
| 1,756,970 | A | * | 5/1930 | Booth | 279/106 |
| 2,526,998 | A | * | 10/1950 | Davis | 279/93 |
| 2,583,264 | A | * | 1/1952 | Friedrich | 409/232 |
| 2,931,659 | A | * | 4/1960 | Novkov | 279/35 |
| 3,420,538 | A | * | 1/1969 | Benjamin et al. | 279/4.01 |
| 3,656,393 | A | * | 4/1972 | Goellner | 83/666 |
| 3,880,546 | A | * | 4/1975 | Segal | 408/204 |
| 3,973,862 | A | * | 8/1976 | Segal | 408/204 |

(Continued)

FOREIGN PATENT DOCUMENTS

| | | |
|---|---|---|
| DE | 90 16 869.0 | 4/1991 |
| DE | 100 17 458 A | 10/2001 |
| DE | 100 17 981 | 10/2001 |

(Continued)

*Primary Examiner*—Daniel W. Howell
(74) *Attorney, Agent, or Firm*—Michael J. Striker

(57) ABSTRACT

The invention is based on a tool holder for a power tool (i0), in particular for a hand-guided power angle grinder, having a slaving device (12) by way of which an inserted tool (14), which has a disklike hub (64), can be operatively connected to a drive shaft (16), and having a fastening device (18) which has a holding position and a release position. It is proposed that with the fastening device (18), the inserted tool (14) can be connected by positive engagement to the slaving device (12) in the circumferential direction (20, 22) in the release position and additionally in the axial direction (24, 26) in the holding position.

9 Claims, 3 Drawing Sheets

U.S. PATENT DOCUMENTS

| | | | | |
|---|---|---|---|---|
| 5,027,684 | A * | 7/1991 | Neukam | 83/461 |
| 5,702,415 | A * | 12/1997 | Matthai et al. | 606/178 |
| 6,780,093 | B2 | 8/2004 | Krondorfer et al. | |
| 6,814,655 | B2 * | 11/2004 | Hofmann et al. | 451/342 |
| 2002/0115394 | A1 | 8/2002 | Krondorfer et al. | |

FOREIGN PATENT DOCUMENTS

| | | | |
|---|---|---|---|
| JP | 63267106 | A * | 11/1988 |
| WO | 01 96067 | A | 12/2001 |

* cited by examiner

TOOL HOLDING FIXTURE AND INSERT TOOL

CROSS-REFERENCE

The invention described and claimed hereinbelow is also described in PCT/DE 03/01229, filed Apr. 11, 2003 and DE 102 25 583.0, filed Jun. 10, 2002. This German Patent Application, whose subject matter is incorporated here by reference, provides the basis for a claim of priority of invention under 35 U.S.C. 119 (a)-(d).

The invention is based on a tool holder and an inserted tool.

From German Patent Disclosure DE 100 17 458 A1, a tool holder for a hand-guided power angle grinder and an inserted tool with a disklike hub are known. The tool holder has a slaving device, by way of which the hub of the inserted tool can be operatively connected to a drive shaft. The tool holder includes a fastening device with detent elements that have a holding position and a release position. The hub of the inserted tool can be operatively connected to the slaving device via the detent elements, which are movable counter to a spring element. Recesses are made in the hub and are engaged by the detent elements, and they fix the inserted tool when it reaches its operating position.

SUMMARY OF THE INVENTION

The invention is based on a tool holder for a power tool, in particular for a hand-guided power angle grinder, having a carrier device, also referred to as a "slaving device" in the following description, by way of which an inserted tool, which has a disklike hub, can be operatively connected to a drive shaft, and having a fastening device which has a holding position and a release position.

It is proposed that with the fastening device, the inserted tool can be connected by positive engagement to the slaving device in the circumferential direction in the release position and additionally in the axial direction in the holding position.

As a result, as soon it is slipped onto the slaving device, the inserted tool is secured in the circumferential direction. The fastening device, which can be moved from the release position to the holding position, additionally secures the inserted tool in the axial direction, in the holding position. The inserted tool can be changed simply, by putting the fastening device into the release position. Because of the positive-engagement connection of the inserted tool with the slaving device already in the release position, when the holding position is reached the fastening device need merely secure the inserted tool in the axial direction as well. As a result, an especially secure, simple construction of the fastening device is attained.

Expediently, changing the inserted tool can be done without tools, making especially simple operation attainable and enabling the inserted tool to be changed quickly. This kind of quick-action chucking system, which already secures the inserted tool on being slipped on in one dimension, specifically the circumferential direction, has high reliability. Unintentional running down of the inserted tool can be reliably avoided, even in the case of braked drive shafts in which high braking moments can occur.

Advantageously, the fastening device includes at least one securing element, which by means of a motion event can be moved from its release position to its holding position, and one motion segment of the motion event extends perpendicular to the axial direction. As a result of the motion perpendicular to the axial direction, the fastening device can fit over the inserted tool in a structurally simple way. A simple, secure mechanism for securing the inserted tool in the axial direction is attainable, and the fit over the inserted tool can be attained structurally simply by means of a translational and/or rotary motion. The fastening device can have one or more securing elements to secure the inserted tool in the axial direction. If the axial direction is secured with a plurality of securing elements, then with a uniform distribution of the securing elements, a uniform and/or symmetrical fastening of the inserted tool can be achieved.

In a further feature of the invention, it is proposed that the fastening device includes at least one securing element, which can be moved from the release position to the holding position by means of a pivoting motion. The securing element can structurally simply fit over the inserted tool as a result of a pivoting motion and secure the inserted tool in a tool holder, and the pivoting motion of the securing element can be effected about an axis that is parallel to the axial direction.

It is also proposed that the securing element have a set of outer teeth. The securing element can be moved about an axis structurally simply via the set of outer teeth with a translational motion and/or with a rotary motion. A securing element that is rotatable about its axis can be integrated with an apparatus of compact design. Moreover, a high degree of user convenience can be attained because a structurally simple ratio, on the order of a gear ratio, is achieved. It is also conceivable for the securing element to be triggered via a control motor and moved into its respective release or holding position.

A simple, convenient construction with which the user can move the securing element into the holding or the release position is attainable by providing that the fastening device includes an adjusting element, and the securing element can be moved from its release position to its holding position by means of a motion of the adjusting element. The adjusting element can be formed by various components considered appropriate by one skilled in the art, such as a screw, an adjusting disk with a gear wheel, and so forth. With an adjusting element that is formed by an adjusting disk that connects a plurality of securing elements by positive and/or nonpositive engagement, an apparatus with which the securing elements can be moved advantageously synchronously can be attained in a structurally simple way. As a result, individual actuation of the securing elements can be dispensed with, which increases the convenience to the user.

Advantageously, the adjusting element has a set of inner teeth that corresponds to the set of outer teeth. As a result, a structurally simple, positive-engagement connection between the adjusting element and the securing element can be attained, and as a result, a non-slip connection between the adjusting element and the securing element can be assured at all times.

In a further feature of the invention, it is proposed that the inserted tool can be prestressed in the axial direction with the aid of the securing element. A tumbling motion of the inserted tool can advantageously be avoided, and safe, precise work can be attained. The prestressing of the inserted tool in the axial direction can be achieved by elastic deformation of the securing element, deformable components such as rubber parts, a securing element that is deflectable in the axial direction, or other provisions that one skilled in the art considers appropriate.

If the securing element is deflectable in the axial direction counter to at least one spring element, then inserted tools whose hubs have different thicknesses can be introduced in a structurally simple way into the tool holder and held or secured without play in the axial direction.

It is also proposed that the fastening device includes at least one plug-in element, with which the inserted tool can be connected by positive engagement to the slaving device in the circumferential direction. A structurally simple apparatus can be attained with which the inserted tool can secured in the circumferential direction already in the release position. Advantageously, individual elements can be designed and dimensioned specially for their particular function. The plug-in element can be formed by an opening, a protrusion, a peg, a bolt, and so forth. The plug-in element can for instance be disposed on the slaving device.

If the inserted tool can be slipped onto a centering collar, then the inserted tool can be centered exactly in the tool holder, and secure, low-vibration operation of the inserted tool is attainable.

The invention also based on an inserted tool for a tool holder, in particular for a power angle grinder, which inserted tool has a hub that can be operatively connected via a slaving device to a drive shaft of the tool holder, and the slaving device includes a fastening device which has a holding position and a release position.

It is proposed that the hub, with the aid of the fastening device, can be connected by positive engagement to the slaving device in the circumferential direction in the release position and additionally in the axial direction in the holding position. The inserted tool is already secured in the circumferential direction on being slipped onto the slaving device. The fastening device, which can be moved from the release to the holding position, secures the inserted tool in the holding position additionally in the axial direction. The inserted tool can be changed easily. Expediently, the inserted tool can be changed without tools, and as a result an especially simple apparatus is attainable and the inserted tool can be changed quickly.

If the hub has at least one recess having a contour which corresponds to an outer contour of the fastening device, coding is advantageously attainable, so that only inserted tools that have been released by the manufacturer can be secured in the tool holder.

Expediently, at least one securing element is capable of reaching through the recess. As a result, the hub of the inserted tool can be secured in the axial direction in the tool holder in a structurally simple way.

BRIEF DESCRIPTION OF THE DRAWING

Further advantages will become apparent from the ensuing drawing description. In the drawing, one exemplary embodiment of the invention is shown. The drawing, description and claims include numerous characteristics in combination. One skilled in the art will expediently consider the characteristics individually as well and put them together to make useful further combinations.

Shown are.

DETAILED DESCRIPTION OF THE EXEMPLARY EMBODIMENT

Figure 1:
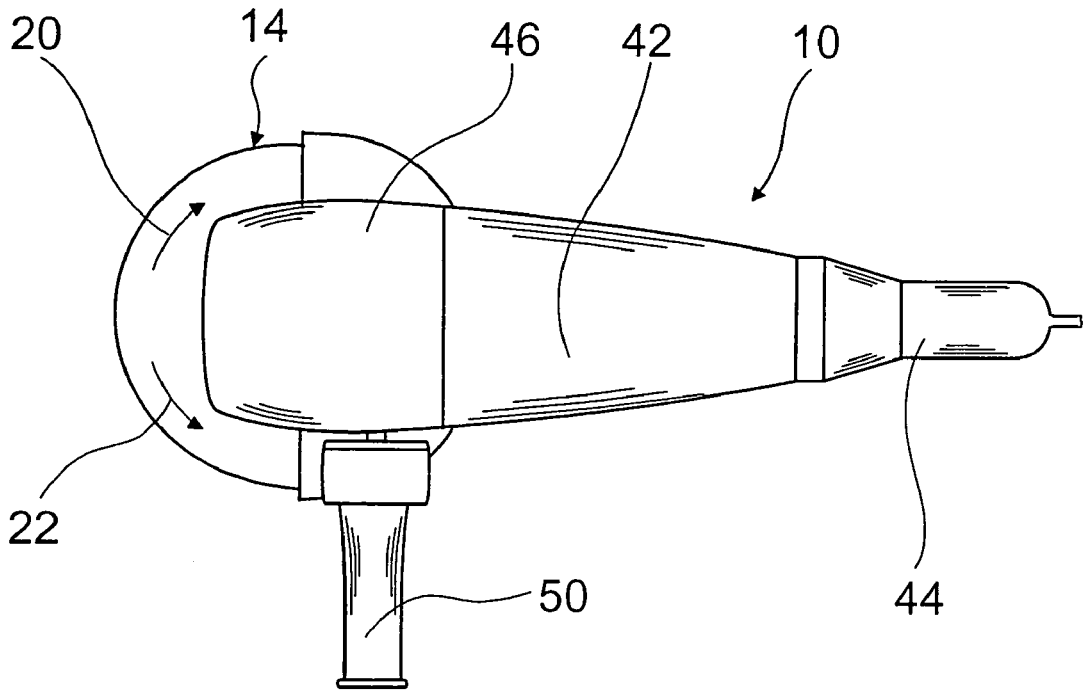
FIG. 1, a schematically shown angle grinder from above.

FIG. 1 shows a power angle grinder 10 from above, with an electric motor, not shown in further detail, supported in a housing 42. The power angle grinder 10 can be guided via handles 44 and 50. The handle 44, which extends in the longitudinal direction of the housing 42, is integrated with the housing 42 on a side remote from the inserted tool 14. The second handle 50 is secured to a gearbox 46 in a region of the inserted tool 14.

Figure 2:
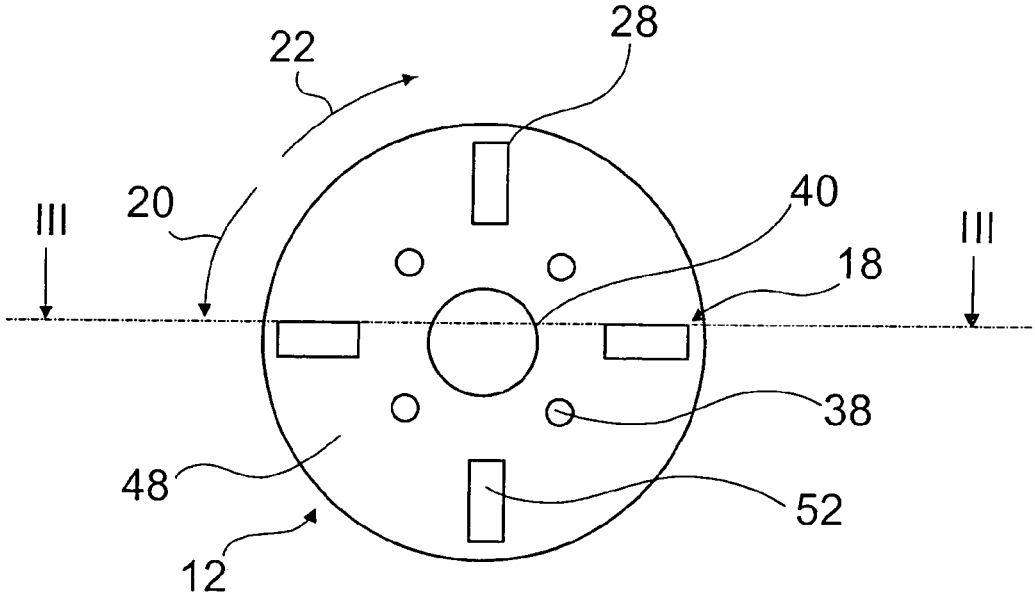
FIG. 2, a tool holder of the invention from below.
Figure 3:
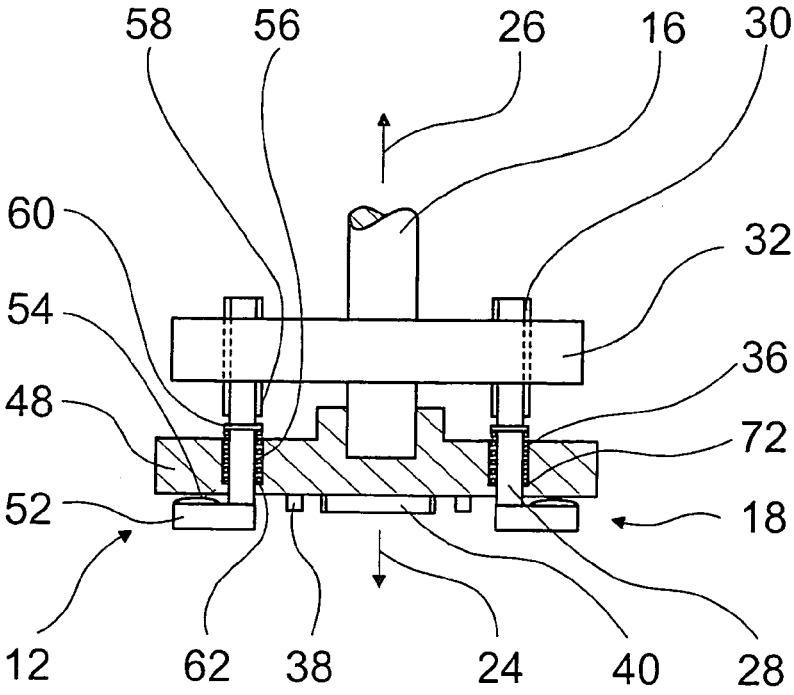
FIG. 3, a fragmentary section through the tool holder of the invention shown in FIG. 2.
Figure 5:
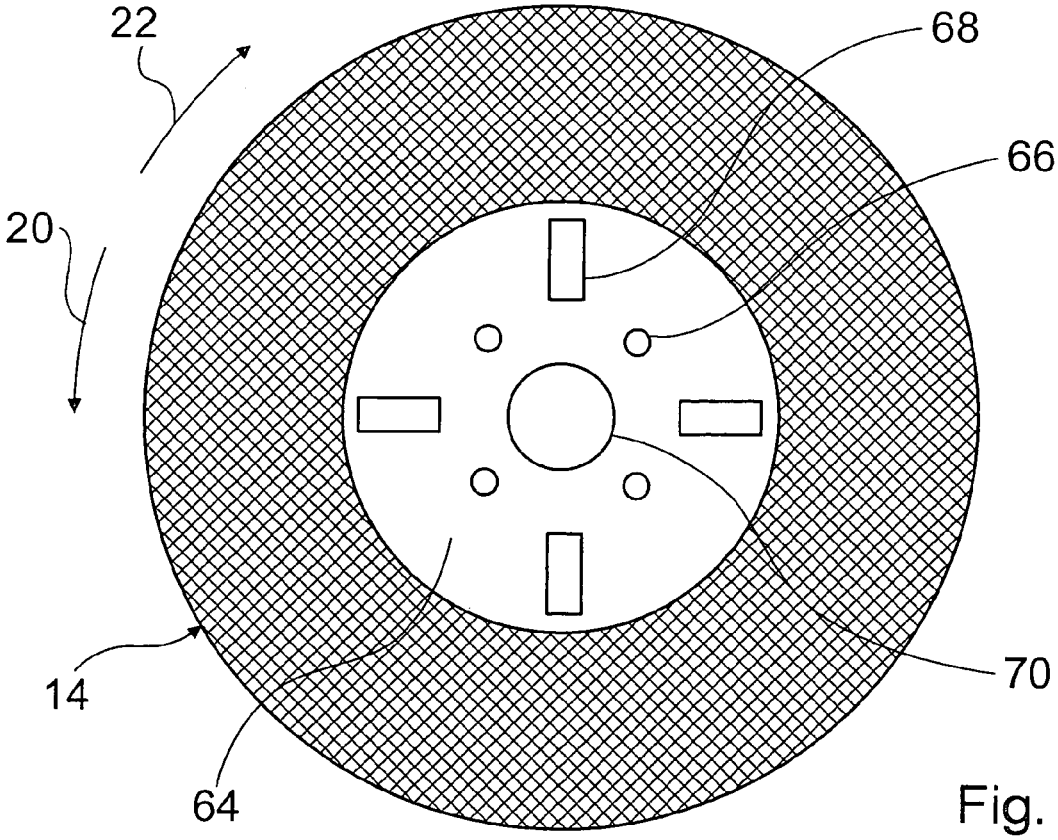
FIG. 5, an inserted tool, with a hub corresponding to the tool holder of the invention.

With the electric motor, via a gear, not shown in further detail, a drive shaft 16 can be driven; a slaving device 12 (FIG. 3) is disposed on its end pointing toward the inserted tool 14. The inserted tool 14 (FIG. 5), which has a disklike hub 64, can be operatively connected to the drive shaft 16 via the slaving device 12. As shown in FIG. 2 and FIG. 3, the slaving device 12 has a slaving device 48, which is firmly connected to the drive shaft 16, and a fastening device 18. The fastening device 18 includes securing elements 28 and plug-in elements 38.

The plug-in elements 38, oriented in the axial direction 24 toward the inserted tool 14, and a concentrically disposed centering collar 40 are disposed on the side of the slaving flange 48 pointing toward the inserted tool 14, and the centering collar 40 likewise points in the axial direction 24 toward the inserted tool 14. The plug-in elements 38, embodied by pins, are distributed uniformly on the slaving flange 48 in the circumferential direction 20, 22. Four through bores 72, distributed uniformly in the circumferential direction 20, 22, are introduced into a radially outer region of the slaving flange 48, and they are offset by an angle of 45° in the circumferential direction 20, 22 from the plug-in elements 38. The securing elements 28 reach through the through bores 72, and a head 52 is formed on each of the ends of the securing elements pointing toward the inserted tool 14. The heads are oriented radially outward, perpendicular to the axial direction 24, 26. Oblique faces 54 are integrally formed onto the heads 52, on the sides pointing in the axial direction 26.

Figure 4:
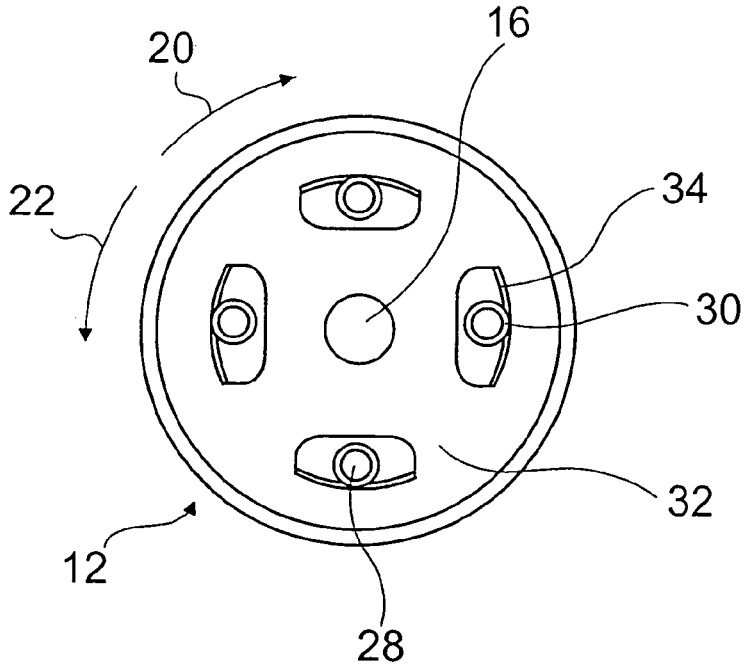
FIG. 4, a plan view on the tool holder of the invention shown in FIG. 2.

In their portions pointing in the axial direction 26, each of the securing elements 28 include a first region 56, which is surrounded by helical compression springs 36, and a second region 58 with a set of outer teeth 30 (FIG. 3 and FIG. 4). With their ends pointing in the axial direction 24, the helical compression springs 36 are braced on radially inward-pointing collars 62 of the through bores 72 and, with their ends pointing in the axial direction 26, they are braced on radially outward-pointing collars 60, both collars being integrally formed onto each of the securing elements 28. The securing elements 28 are movable in the axial direction 24 counter to the spring forces of the helical compression springs.

The sets of outer teeth 30 in the second regions 58 of the securing elements 28 mesh by positive engagement with a corresponding set of inner teeth 34 of an adjusting element 32. The adjusting element 32 is designed as a knurled disk and fits over the securing elements 28 (FIG. 3 and FIG. 4).

The hub 64, made from sheet metal, of the inserted tool 14 has a centering bore 70. Recesses 66, 68 whose contour corresponds to an outer contour of the fastening device 18 are made in the hub 64. The recesses 66 are formed, in a radially inner region, by four bores distributed uniformly in the circumferential direction 20, 22. In radially outer region, rectangular recesses 68 that correspond with the securing elements 28 are made in the hub 64. The contour of each of the recesses 68 corresponds to a respective outer contour of the heads 52 of the securing elements 28.

For assembly, the inserted tool 14 is slipped onto the centering collar 40 and centered via the centering bore 70 of the hub 64. Upon assembly, the plug-in elements 38 and the securing elements 28, with their heads 52, reach through the recesses 66 and 68, respectively, in the hub 64. The inserted tool 14 is secured in the circumferential direction 20, 22 by way of the positive engagement of the recesses 66 with the plug-in elements 38 and of the recesses 68 with the securing elements 28, the securing elements 28 being in a release position.

For additionally securing the inserted tool 14 in the axial direction 24, 26, the securing elements 28 of the fastening device 18 are moved into a holding position. For this purpose, the adjusting element 32 is actuated by a user in the circumferential direction 20, 22. Because of the positive engagement of the inner and outer sets of teeth 30, 34, respectively, the securing elements 28 can be moved from the release to the holding position by a pivoting motion in a plane perpendicular to the axial direction 24, 26. The heads 52 of the securing elements 28 slide with their oblique faces 54 over the hub 64 of the inserted tool 14. The motion of the securing elements 28 in the axial direction 24 counter to the spring force of the spring elements 36 causes the hub 64 to press against the slaving flange 48. The inserted tool 14 is clamped in the axial direction 24, 26 with the aid of the securing elements 28.

For removal of the inserted tool 14 or the sheet-metal hub 64, the adjusting element 32 is moved in the circumferential direction 20, 22 until the securing elements 28 have reached their release position. The inserted tool 14 can then be removed in the axial direction 24.

LIST OF REFERENCE NUMERALS

10 Power tool
12 Slaving device
14 Inserted tool
16 Drive shaft
18 Fastening device
20 Circumferential direction
22 Circumferential direction
24 Axial direction
26 Axial direction
28 Securing element
30 Set of outer teeth
32 Adjusting element
34 Set of inner teeth
36 Spring element
38 Plug-in element
40 Centering collar
42 Housing
44 Handle
46 gearbox
48 slaving flange
50 Handle
52 Head
54 oblique faces
56 Region
58 Region
60 Collar
62 Collar
64 Hub
66 Recess
68 Recess
70 centering bore
72 through bore

The invention claimed is:

1. A tool holder for a power tool (10), having a carrier device (12) by way of which an inserted tool (14), which has a disklike hub (64), can be operatively connected to a drive shaft (16), and having a fastening device (18) which has a holding position and a release position, wherein with the fastening device (18), the inserted tool (14) can be connected by positive fitting to the carrier device (12) in the circumferential direction (20, 22) in the release position and can be connected by positive fitting to the carrier device (12) in the circumferential direction (20, 22) and additionally in the axial direction (24, 26) in the holding position, wherein the fastening device (18) includes at least one securing element (28), which can be moved from the release position to the holding position by means of a pivoting motion, and wherein the securing element (28) has a set of outer teeth (30).

2. The tool holder of claim 1, wherein the fastening device (18) includes at least one securing element (28), which by means of a motion process can be moved from its release position to its holding position, and one movement section of the motion process extends perpendicular to the axial direction (24, 26).

3. The tool holder of claim 1, wherein the fastening device (18) includes an adjusting element (32), and the securing element (28) can be moved from its release position to its holding position by means of a motion of the adjusting element (32).

4. The tool holder of claim 3, wherein the adjusting element (32) has a set of inner teeth (34) corresponding to the set of outer teeth (30).

5. The tool holder of claim 2, wherein the inserted tool (14) can be clamped in the axial direction (24, 26) with the aid of the securing element (28).

6. The tool holder of claim 5, wherein the securing element (28) can be deflected in the axial direction (24) counter to at least one spring element (36).

7. The tool holder of claim 1, wherein the fastening device (18) includes at least one plug-in element (38), wherein the inserted tool (14) can be connected by positive fitting to the carrier slaving device (12) in the circumferential direction (20, 22) with said at least one plug-in element (38).

8. The tool holder of claim 1, wherein the inserted tool (14) can be slipped onto a centering collar (40).

9. A tool holder for a hand-guided power angle grinder, having a carrier device (12) by way of which an inserted tool (14), which has a disklike hub (64), can be operatively connected to a drive shaft (16), and having a fastening device (18) which has a holding position and a release position, wherein with the fastening device (18), the inserted tool (14) can be connected by positive fitting to the carrier device (12) in the circumferential direction (20, 22) in the release position and can be connected by positive fitting to the carrier device (12) in the circumferential direction (20, 22) and additionally in the axial direction (24, 26) in the holding position, wherein the fastening device (18) includes at least one securing element (28), which can be moved from the release position to the holding position by means of a pivoting motion, and wherein the securing element (28) has a set of outer teeth (30).

* * * * *